US005774559A

United States Patent [19]

Feng

[11] Patent Number: 5,774,559

[45] Date of Patent: Jun. 30, 1998

[54] METHOD AND APPARATUS FOR DETERMINING PERCEIVED ROUGHNESS OF POWERTRAIN SOUNDS

[75] Inventor: Ben John Feng, Ann Arbor, Mich.

[73] Assignee: Ford Global Technologies, Inc., Dearborn, Mich.

[21] Appl. No.: 790,872

[22] Filed: Feb. 3, 1997

[51] Int. Cl.[6] ..... H04R 29/00

[52] U.S. Cl. ..... 381/56; 381/86; 381/73.1; 364/485

[58] Field of Search ..... 381/56, 86, 73.11, 381/94.1, 94.3; 364/487, 485

[56] References Cited

U.S. PATENT DOCUMENTS 5,535,131 7/1996 Sanders ..... 364/487

OTHER PUBLICATIONS

"Berechnungsverfahren Fur–Den Wohlklang Beliebiger–Schallsignale, Ein Beitrag Zur Gehorbezogenen Schallanalyse", Ph.D. Thesis, Wilhelm Aures (Technical University of Munich, 1984), pp. 56–58.

"A Common Model For Loudness and Roughness", A. Vogel, Bio. Cybrenetics, 1975, pp. 1–25.

"Psychoacoustics, Facts & Models", Springer Verlag, 1990, pp. 228–236.

*Primary Examiner*—Forester W. Isen

*Attorney, Agent, or Firm*—Mark L. Mollon; Roger L. May

[57] ABSTRACT

A powertrain roughness model is based on a structure comprising an auditory filterbank for spectral decomposition of the powertrain sound signals into a set of critical bandwidth channels, a model for predicting the specific roughness in each critical band channel, and a critical band to wide band converter that combines the specific roughness in each channel into a single roughness value.

13 Claims, 2 Drawing Sheets

METHOD AND APPARATUS FOR DETERMINING PERCEIVED ROUGHNESS OF POWERTRAIN SOUNDS

TECHNICAL FIELD

This invention relates to analyzing powertrain sounds to predict perceived roughness.

BACKGROUND ART

Studies of customer preference have shown that the dimension of rough/smooth is an important factor in determining the subjective quality of powertrain sounds. Therefore, it would be desirable to have an objective means for quantifying perceived roughness for use in powertrain development activities.

The human auditory system divides incoming /sounds into separate frequency regions (potentially numbering in the hundreds), each stimulating a different segment along the length of the organ of Corti. Each frequency region is then 'processed' separately (mostly) to yield neural activity in different parts of the auditory nerve.

Most models of auditory sensations include a bandpass filterbank in their structure (e.g. an auditory filterbank). The salient characteristics of these are: fixed channel center frequencies, non-overlapping passband regions. Another model contains processing to account for the phenomenon known as simultaneous masking and uses it to predict the degree of roughness that the sound in one filterbank channel will add to adjacent, higher frequency channels. None of the existing models for roughness are suitable for analyzing vehicle powertrain sound.

SUMMARY OF THE INVENTION

The roughness model of the present invention is based on a structure comprising an auditory filterbank for spectral decomposition of wide bandwidth signals into a set of critical bandwidth channels, a model for predicting the specific roughness in each critical band channel, and a critical band to wide band converter that combines the specific roughness in each channel into a single roughness value. Each of these three stages incorporates new and unique features representing fundamental characteristics of human auditory behavior.

The auditory filterbank employs a set of critical bandwidth filters each having a center frequency and bandwidth that is adaptively assigned based on the spectral content of the specific signal being analyzed. The resulting dense coverage of the audible spectrum is an accurate reflection of how human auditory processing is observed to behave. It provides an additional benefit in reducing filter band structure related anomalies such as band edge distortion.

The model of specific roughness uses estimates of modulation at multiple frequencies in a power law model of perception. A further feature is incorporation of "ceiling" function that reflects the saturation of roughness perception for critical bandwidth signals containing a large number of narrowband components. These two features optimize the model of specific roughness for powertrain sound, and other sources that are dominated by a narrowband harmonic structure such as electrical motors. The model can be represented analytically as:

$$\text{Specific Roughness} \propto F\left[\sum_i (w_i m_i)^2\right]^{1/2} \tag{1}$$

where $m_i$ represents the estimated modulation strength of the signal at the ith frequency measurement point and $w_i$ is a perceptual weighting factor that is dependent upon modulation frequency and channel center frequency.

The roughness model addresses the task of combining narrowband results into a roughness measure for the wideband signal in a fundamentally new manner. It does this by identifying and considering only those channels which dominate the sensation of roughness, and discarding from further computation those channels that do not contribute significantly to overall roughness. This is accomplished by means of a masking model which incorporates a number of features that distinguish it from other masking models. First, it employs a two parameter model of auditory filter slope, and an alternative roex(p,w,t) type auditory filter prototype. Second, it incorporates a model of masking additivity, an effect that is ignored in other masking models, but that can have a profound effect on the accuracy of masked threshold prediction. Third, it has been empirically optimized for masking by multiple narrowband frequency components. This masking model is used to predict the relative audibility of the signal's components relative to their location in frequency.

In brief, the narrow-band to wideband conversion can be represented by the equation:

$$\text{Overall Roughness } R = \sum_i M_i(PSD) N_i [c_i r_i^2]^{1/2} \tag{2}$$

where PSD is the power spectral density of the input signal, $M_i$ is a binary valued indicator function for the ith critical band channel based on a model of masking, $N_i$ is another indicator function that eliminates the contribution of audible critical bands channel. The function Ni is necessary because the dense overlapping in the auditory filterbank can cause adjacent critical band channels to predict roughness due to a single spectral feature. In these cases, it is desirable to choose only one specific roughness value to represent the roughness of that single feature even though the masking function reports that both channels are significant. The function $N_i$ equals one only if the adjacent channels, i−1 and i+1, do not have greater roughness (e.g. $r_i > r_{i+1}$ and $r_i > r_{i-}1$). In this way, it is effectively peak picking amongst the specific roughness values. One very important result of this strategy is that the model does not overestimate roughness for complex signals. This can be attributed to the fact that the model eliminates redundancy due to auditory filterbank channel overlap, and avoids the inclusion of channels which, by themselves are rough but, are not audible as part of the whole signal.

Once the dominant critical band channels have been identified, their specific roughness values are combined according to a powerlaw model which incorporates not only frequency dependent weighting (as in existing roughness models), but also level dependent weighting.

BRIEF DESCRIPTION OF THE DRAWINGS

A more complete understanding of the present invention may be had from the following detailed description which should be read in conjunction with the drawings in which.

DETAILED DESCRIPTION OF PREFERRED EMBODIMENT

Roughness is a term used to describe a particular auditory sensation, most easily elicited by listening to an amplitude modulated tone. It is a subjective or perceptual quantity in the same manner as the loudness or pitch of a sound. The present invention proposes an objective model for predicting this sensation for powertrain sound.

Figure 1:
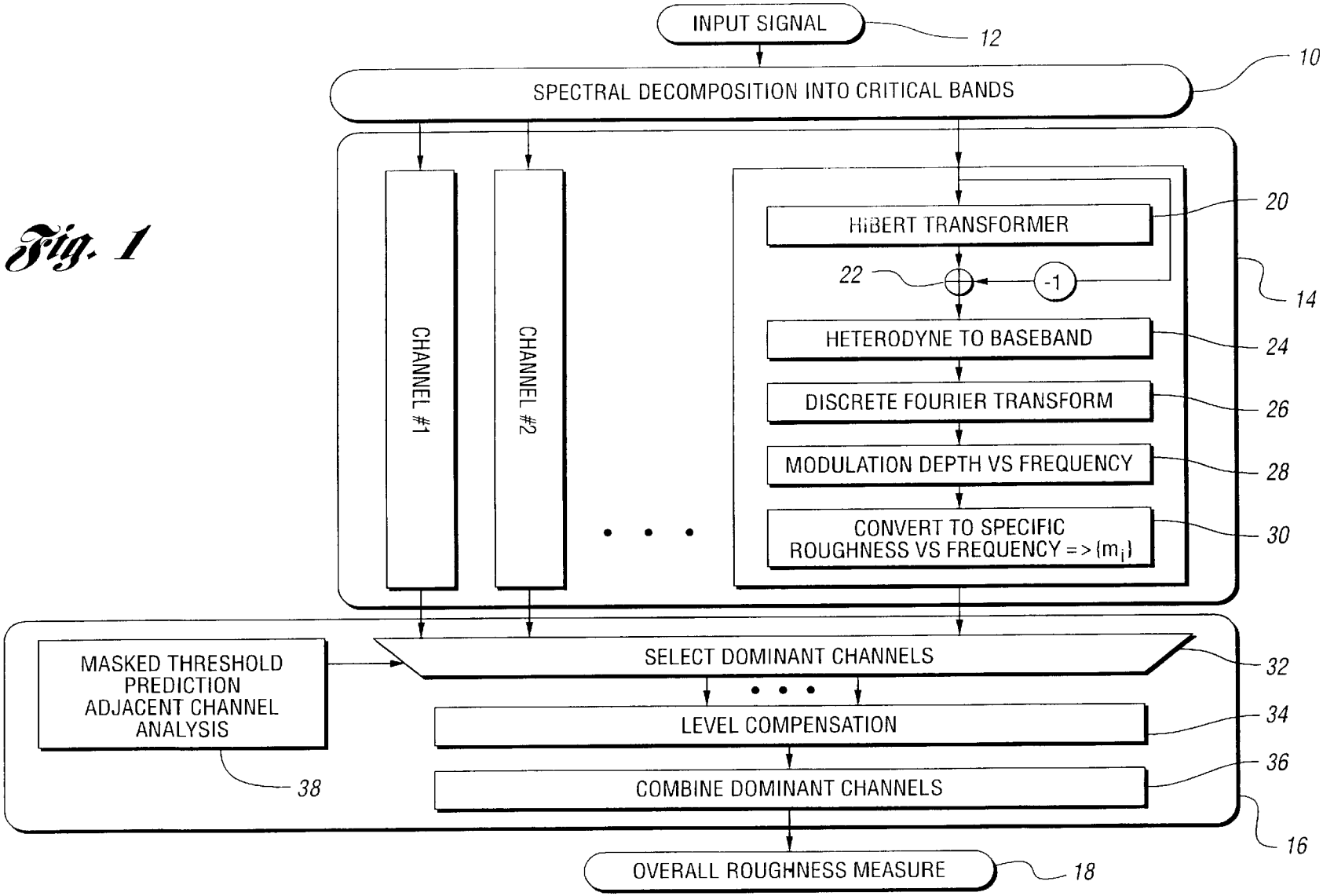
FIG. 1 is a functional block diagram of a preferred embodiment of the invention.

The model consists of three main functional block as shown in FIG. 1. An auditory filterbank 10 (AFB) decomposes an input sound signal 12 into specific frequency regions. A specific roughness model generally designated 14 estimates specific roughness in each AFB channel. A narrow to wideband model 16 combines specific roughness levels from the individual channels into an overall roughness value indicated at 18.

The auditory filterbank 10 is a set of bandpass filters the purpose of which is to decompose a powertrain roughness sound or other automotive sound quality into a set of band-limited signals. In this way it mimics the behavior of the basilar membrane. The center frequency and bandwidth of each filterbank channel are adaptive (signal dependent). One channel is centered at each half and whole integer harmonic of the powertrain's fundamental rotational frequency (e.g. 0.5, 1.0, 1.5, 2.0, etc., of the fundamental engine order). As the powertrain fundamental and harmonic frequencies change, the filter center frequencies change accordingly. The bandwidths of the filters are set to approximate the "critical" bandwidth of the human auditory system. There are a variety of expressions for predicting critical bandwidth as a function of center frequency. The roughness model uses an expression proposed by Patterson & Holdsworth (Advances in Speech, Hearing and Language Processing, Vol 3., JAI Press, London), $$ERB = 24.7\left(\frac{4.37f_c}{1000} + 1\right) \tag{3}$$

where $f_c$ is the center frequency for the desired frequency band. Because the center frequencies change with powertrain rpm variations, the filter bandwidths are thereby also adaptive. The number of filter channels is specified by the user, depending on what range of powertrain harmonics are of interest. The bandpass filters themselves are implemented as an 8th order IIR Butterworth design.

Once an input signal has been spectrally decomposed into a set of discrete, bandpass signals via the auditory filterbank, specific roughness is predicted for each signal at block 14. The first step in this prediction procedure is to extract the temporal domain envelope using a Hilbert transform based signal processing technique as indicated at blocks 20–24. The Hilbert Transform 20 generates a version of the input signal with inverted negative frequency components. The output of the summation at 22 is therefore an analytic signal. The Heterodynes 24 are simply a frequency shift of the analytic bandpass signal into a low frequency signal. The shift is accomplished via a complex (e.g. complex valued) multiplicative factor that is computed according to the 'shift' properties of the discrete Fourier transform. The resulting envelope is the time domain modulation signal of the bandpass input signal. The next step is to determine the spectral characteristics of the envelope such as the modulation strength by transforming the envelope into the frequency domain using a discrete time Fourier transform 26. Then the effective modulation depth at the half, first, one and a half, and second powertrain harmonic frequencies are measured at 28. Those modulation depths are converted into specific roughness values at 30 through a process described by the following equation:

$$\text{Specific Roughness} \propto r_i = F\left[\sum_i (w_i m_i)^2\right]^{1/2} \tag{4}$$

where: F[ ] is a hard limiting function at 80% modulation depth, $w_i$ are weights that characterize the dependence of roughness on modulation/center frequency, and $m_i$ are the modulation depths at the frequencies previously mentioned.

Figure 2:
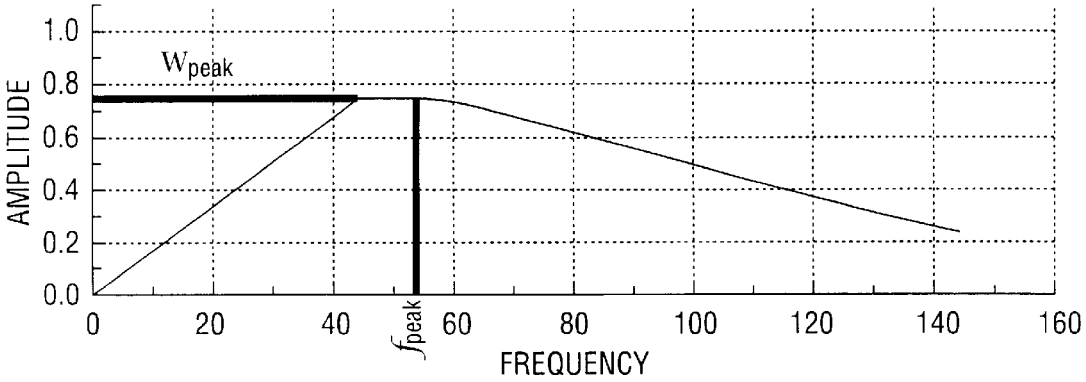
FIG. 2 is a plot of data on which a weighting function used in converting modulation depth to specific roughness is based.

The weighting function, $w_i$ is based on published roughness sensitivity data. According to the present invention the following equations (5, 6, 7) that characterize this data were developed for the roughness model. The data is implemented as a piecewise linear function having three segments and of the general form shown in FIG. 2. The three segments are:

1. A center portion: constant from 90% to 105% of center frequency.
2. Upper and lower portions: constant linear function, defined by an upper and lower slope parameter (0.017 and 0.45 respectively). The location in frequency is simply the center frequency of the auditory filterbank channel of interest. The frequency of the weighting function maximum (55 Hz in this example) is determined by the relation, $$\text{Max. Freq.} = f_{peak} = 30\text{ Hz} + 5\left(\frac{F_c}{125}\right) \tag{5}$$

where $F_c$ is the center frequency of the channel of interest. The upper and lower sloped portions of the weighting curve are computed according to a power-law relationship as:

$$w(f) = W_{peak} - \left(\frac{\Delta f}{f_{peak}}\right)^{0.90}\text{Slope} \tag{6}$$

where $\Delta f = (f - f_{peak})$. The maximum value of the weighting function (0.75 in this example) is computed according to the expression:

$$W_{peak} = 0.32 + 0.655\log(F_c/125). \tag{7}$$

Once specific roughness has been computed, the model combines specific roughness values into an overall value in a way that ignores those portions of a sound which don't contribute significantly to the overall perception of roughness. In this way, the model essentially throws out those specific roughness values which are not important. Only specific roughness values from those channels which dominate the overall perception of roughness are considered as indicated at 32. The specific roughness in each 'dominant' auditory filterbank channel is adjusted to reflect dependence of roughness on level as indicated at block 34. This is done via the weighting factor in equation (6), defined as:

$$\text{compensation} = 1_i = 2^{[(RMS_i - 60.0)/20]} \tag{8}$$

where RMS is the root-mean-square signal energy in the ith channel. This reduced set of values is combined at block 36 according to a power-law relationship, as shown in the equation (9) below. The variable, $1_i$, is a multiplicative factor that compensates for the dependence of roughness on level.

The method for identifying which channels dominate a sound uses three types of information: audibility of the signal in a channel, its ability to $$\text{Roughness} \propto \left[ \sum_{i \in \text{Dominant}} l_i r_i^2 \right]^{1/2} \tag{9}$$

produce roughness, and its correlation with adjacent channels. First, a prediction of the "auditory masked threshold" is made at 38. This threshold indicates whether or not a particular portion of a signal is audible relative to the entire sound. If the signal in a filterbank channel is not audible, then it cannot contribute to roughness, and should be ignored. Second, for each audible channel, the number of tonal components above threshold is measured. If the signal in a channel does not contain a sufficient number of audible, narrow band components to elicit roughness (2 or more), it is also discarded. Finally, if a pair of audible adjacent channels are strongly correlated (overlapped in frequency and containing similar roughness), the channel with the highest roughness is kept and the other discarded.

The audibility of any part of a sound can be determined if the masked auditory threshold for the sound is known. Components of the sound above threshold are audible, and ones below threshold are not. The main psychophysical phenomenon that is responsible for this threshold is known as simultaneous masking. It is, in simple terms, the effect where the presence of a signal component at one frequency suppresses the threshold of audibility of a signal component at another frequency. This effect can be predicted if the shape of the auditory filter is known. The roughness model can employ two different models of auditory filter shape. The first is a simple, two parameter model that assumes the auditory filter shape is described by a pair of logarithmic functions of the form:

$$W(f) = C \times \log(|f - f_{peak}|)\ C \tag{10}$$

where the constant, C, differs for frequencies above and below the filter center. The default constants are:

$$C_{upward} = 150\text{db/octave and } C_{downward} = 250\text{db/octave.} \tag{11}$$

In addition to the constant slope models, the model can also be employed with a more sophisticated auditory filter shape model based on the 'roex' filter function. The roexo filter is a doubly exponential function that more accurately models empirical measurements of auditory filter shape. It is expressed as:

$$\text{roex}(p,w,t) = (1-w)(1+pg)\,e^{-pg} + w(1+tg)\,e^{-tg} \tag{12}$$

where $g = |f - f_c|/f$, and $f_c$ is the center frequency of the filter. The p parameter is determined as:

$$p = \frac{4f_c}{ERB(F_c)} \tag{13}$$

where $$ERB(f) = 2.47\left(4.37\left(\frac{f}{1000}\right) + 1\right), \tag{14}$$

and the default t and w parameters are:

$$t = \frac{p}{3} \tag{15}$$

and $$w = 1.0e - 6. \tag{16}$$

and

Figure 3:
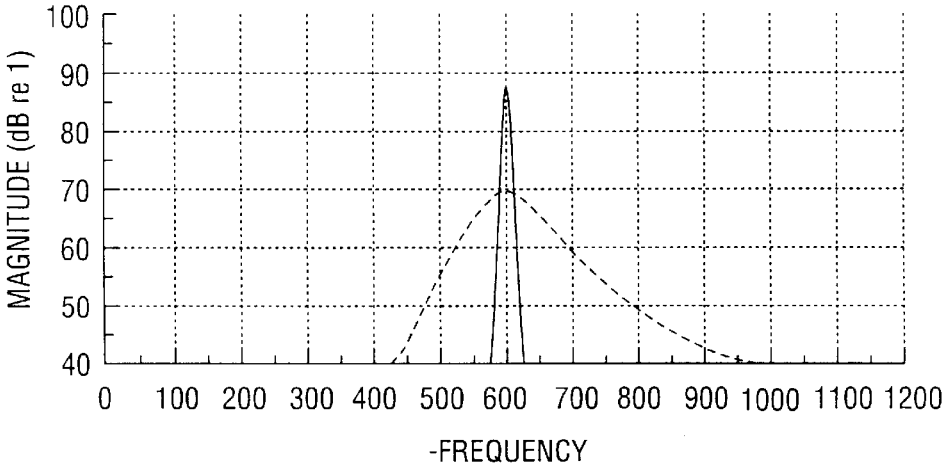
FIG. 3 is a plot illustrating the masked threshold for a single sine tone.
Figure 4:
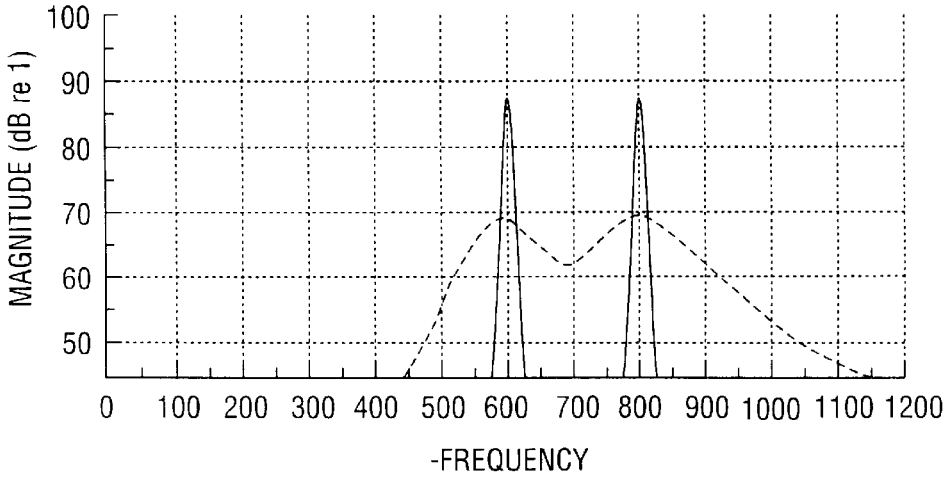
FIG. 4 illustrates the results of adding two individual thresholds.

Given a model of auditory filter shape, the masked threshold for a sound can be estimated. In the case of powertrain sound, it is known a priori that the signal will be dominated by narrowband tonal components. Each of these components will elicit a response on the basilar membrane (BM), the effect of which is described (in part) by a magnitude function, centered at the frequency of the component, and with shape described by the appropriate roex(p,w,t) filter. The plot shown in FIG. 3 illustrates the masked threshold for a single sine tone. Therefore, the first steps in determining the masked threshold is to identify all the narrowband, tonal components in a sound, and then to associate with each component a response as predicted by the roexo() filter function. The responses from each component only indicate the theoretical response for that single component as presented in isolation. In order to combine them into an aggregate response, a model of "masking additivity" is employed. This model is a mathematical function that indicates how thresholds from individual signal components are to be summed. The model is represented by the expression:

$$J(M_{AB}) = J(M_A) + J(M_B) \tag{17}$$

where J() is the powerlaw transform:

$$J(M_x) = [10^{(M_x/10)}]p \tag{18}$$

and p =0.6. Using this relationship, the individual responses are combined into an aggregate threshold response. The plot in FIG. 4 illustrates what the result of 'adding' two individual thresholds looks like. Components which fall below this aggregate threshold do not contribute to it. When all the signal components have been accounted for —either as contributing to the aggregate threshold or as not contributing because they lie below the threshold —and then combined with the masking additivity model, the result is an auditory masked threshold prediction for the signal. It should be understood that the "p" parameter used (nominally 0.6) is actually adjustable to suit the application.

Because the auditory filterbank channels overlap in frequency, adjacent channels can contain redundant roughness information. Therefore, when overlapping channels have strongly correlated envelopes only one is retained for use in computing overall roughness. The procedure for identifying which of an adjacent pair to retain is:

1. retain that which has higher audibility;
2. if audibility is about the same (less than 10% difference), retain the one which has higher specific roughness.

While the best mode for carrying out the present invention has been described in detail, those familiar with the art to which this invention relates will recognize various alternative designs and embodiments for practicing the invention as defined by the following claims.

What is claimed is:

1. A roughness analyzer for predicting perceived roughness of powertrain sounds comprising:

an auditory filterbank for spectrally decomposing powertrain sound signals into a set of critical bandwidth signals;

means for determining the specific roughness of said critical bandwidth signals;

means for summing the specific roughness of only those individual signals that dominate the sensation of roughness to obtain an overall roughness measure.

2. The analyzer of claim 1 wherein said filterbank comprises a set of critical bandwidth filters that are adaptively assigned based on the spectral content of the signal being analyzed.

3. The analyzer of claim 1 wherein the channels that dominate the sensation of roughness are determined based on audibility of the signal in a channel, the ability of the signal to produce roughness, and the correlation of the signal with signals in adjacent channels.

4. The analyzer of claim 3 wherein the audibility of the signal is determined from a predicted auditory masked threshold that indicates whether or not a particular portion of a signal is audible relative to the entire sound.

5. The analyzer of claim 4 wherein the number of tonal components above threshold is measured for each audible channel and the signal in a channel is discarded if it does not contain a predetermined number of audible, narrow band components.

6. The analyzer of claim 5 where if a pair of audible adjacent channels are strongly correlated the channel with the highest roughness is kept and the other discarded.

7. A method of determining perceived roughness of a powertrain sound signal comprising:

spectrally decomposing the powertrain sound signal into a set of critical bandwidth channels;

predicting the specific roughness in each critical bandwidth channel; and combining the specific roughness in only those channels that dominate the sensation of roughness to obtain an overall roughness measure.

8. The method defined in claim 7 wherein spectrally decomposing the powertrain sound into a set of critical bandwidth channels includes adaptively assigning center frequencies and bandwidths to said channels based on the spectral content of the powertrain sound signal.

9. The method defined in claim 7 wherein predicting the specific roughness uses estimates of modulation at multiple frequencies in a power law model of perception and incorporates a ceiling function that reflects the saturation of roughness perception for critical bandwidth signals containing a large number of narrowband components.

10. The method defined in claim 7 wherein predicting the specific roughness may be expressed as:

$$\text{Specific Roughness} \propto F\left[\sum_i (w_i m_i)^2\right]^{1/2}$$

where $m_i$ represents the estimated modulation strength of the signal at the ith frequency measurement point and $w_i$ is a perceptual weighting factor that is dependent upon modulation frequency and channel center frequency.

11. The method defined in claim 7 wherein predicting the specific roughness includes identifying and considering only those channels which dominate the sensation of roughness, and discarding from further computation those channels that do not contribute significantly to overall roughness.

12. The method defined in claim 7 wherein combining the specific roughness in each channel into a single roughness value includes predicting the relative audibility of the signal's components relative to their location in frequency.

13. The method defined in claim 12 wherein combining the specific roughness in each channel into a single roughness value may be represented by:

$$\text{Overall Roughness } R = \sum_i M_i(PSD)N_i[c_i r_i^2]^{1/2}$$

where PSD is the power spectral density of the input signal, $M_i$. is a binary valued indicator function for the ith critical band channel based on a masking model, $N_i$ is an indicator function that eliminates the contribution of audible critical bands channel.

* * * * *